US006270231B1

(12) United States Patent
Kerr

(10) Patent No.: US 6,270,231 B1
(45) Date of Patent: Aug. 7, 2001

(54) FLASHLIGHT HOLDER

(76) Inventor: Daniel G. Kerr, 2922 East 25th Avenue, Vancouver, British Columbia (CA), V5R 1J2

( * ) Notice: Subject to any disclaimer, the term of this patent is extended or adjusted under 35 U.S.C. 154(b) by 0 days.

(21) Appl. No.: 09/213,095

(22) Filed: Dec. 10, 1998

Related U.S. Application Data

(63) Continuation-in-part of application No. 09/014,037, filed on Jan. 27, 1998, now Pat. No. 5,848,834, which is a continuation-in-part of application No. 08/713,217, filed on Sep. 12, 1996, now Pat. No. 5,743,623.

(51) Int. Cl.[7] ..... F41G 1/34
(52) U.S. Cl. ..... 362/110; 362/191
(58) Field of Search ..... 362/110, 111, 362/113, 114, 190, 191; 42/103

(56) References Cited

U.S. PATENT DOCUMENTS

| | | | |
|---|---|---|---|
| 1,865,127 | 6/1932 | McKeen | 362/110 X |
| 3,222,511 | 12/1965 | Breeding | 362/110 |
| 5,621,999 | 4/1997 | Moore | 362/110 X |
| 5,848,834 | 12/1998 | Kerr | 362/110 X |

OTHER PUBLICATIONS

Laser Products, "Sure Fire Tactical Light & Laser Systems Handbook & Components Selection Guide", Spring 1995 Edition pp. 10 and 11.

Pachmayr 1998 Product Catalog pp. 6 and 8.

*Primary Examiner*—Stephen Husar

(57) ABSTRACT

A flashlight holder for use with flashlights and which permits the user to control the flashlight while handling another item, such as a firearm. The flashlight holder has a removably attachable collar coupled to a handle. The handle is dimensioned so as to permit the user to control a flashlight to which the collar is attached by holding the handle with a few fingers while making the same hand available for other activities, such as holding a firearm.

3 Claims, 10 Drawing Sheets

FLASHLIGHT HOLDER

RELATED APPLICATIONS

This application is a continuation-in-part of U.S. patent application Ser. No. 09/014,037 filed Jan. 27, 1998, now issued as U.S. Pat. No. 5,848,834, which in turn is a continuation-in-part of U.S. patent application Ser. No. 08/713,217 filed Sep. 12, 1996 and now issued as U.S. patent No. 5,743,623.

FIELD

The present invention relates to a flashlight holder for use with flashlights and which permits the user to control the flashlight while handling another item, such as a firearm. The flashlight holder may be removably attached to or may be integral with and form part of the flashlight casing.

BACKGROUND

Conventional flashlight handles, while useful, make it difficult for the user to hold the handle while using the hand for other activities, and as such are unsuitable or undesirable in certain circumstances. For instance, in the area of law enforcement and security operations, it is desirable that a flashlight handle enable the user to readily hold and direct the flashlight while freeing up the same hand for other uses, such as for the control of a firearm. Moreover, many flashlights lack handles altogether. In order to control both a firearm and a flashlight in combination, officers are typically required to hold a flashlight in one hand while holding the firearm in the other, thereby compromising the support and stability that is otherwise available in employing a firearm with two hands. One method of reducing some of the loss of support arising when dedicating one hand to employing a flashlight is for an officer to extend the arm with the hand holding the firearm across and on top of the arm with the hand holding the flashlight. This method, however, requires constant readjustment when an officer is in motion or after discharging a firearm and does not direct the beam of light directly along the light of sight of the firearm muzzle. Existing flashlights with built-in holders aggravate the problems as the holder design is uncomfortable and difficult to grip when using a device such as a firearm. Furthermore, existing flashlights with built-in holders have a design which makes it impractical for an officer to wear such a flashlight around the waist when it is not in use.

In co-owned U.S. patent application Ser. No. 08/713,217, now issued as U.S. Patent No. 5,743,623, there is provided a flashlight holder which attends to the above needs in the art and enables a user to readily hold a flashlight in combination with a firearm. While the flashlight holder in U.S. patent application Ser. No. 08/713,217 provides a useful improvement in the art, additional flashlight holder structures presented herein have been invented which offer alternative means for controlling a flashlight. Moreover, with the variety of flashlights on the market, there remains a continuing need for alternative flashlight holders.

As previously mentioned, it is most desirable to use two hands when employing a firearm. There exists in the art flashlight holders which are attached directly to firearms, thereby permitting the user of the firearm to place both hands on the weapon. However there are a variety of difficulties associated with these designs. One known design consists of a specially molded forestock that replaces the standard forestock on a shotgun. Contained within the adapted forestock is a dedicated housing for a flashlight, which includes an integrated pressure switch that operates the flashlight. This design is somewhat impractical and expensive since it requires that the entire forestock of the shotgun be replaced in order to attach the integrated flashlight and holder mechanism. Since the holder and flashlight consist of one piece, the flashlight can also not be removed, should the user wish to do so. This holder design also requires that the flashlight be located underneath the barrel of the gun, so the flashlight is not easy to see and access. More importantly, this design is not suitable for many types of firearms, such as handguns.

Another known flashlight holder consists of a mounting clip in a double collared shape which attaches directly to the end of the barrel, ammunition tube, or forestock of a firearm. This holder is associated with a flashlight that is attached to a pressure sensitive switch located at the end of an expandable, curled cord which allows the user to affix the switch to a convenient location on the firearm. This design can be problematic since the expandable cord could easily become entangled while the firearm is in use and create a safety hazard.

Consequently, a need exists for a flashlight holder which is adaptable to any type of firearm, inexpensive, and easy to install and remove from the firearm. Such a design must also allow the firearm user easy access to the flashlight, and must ensure that the flashlight remains visible. This design will also permit the user to have both hands directly on the firearm without having to place one hand on top of a switch in order to operate the flashlight.

Accordingly, it is an object of the invention to provide alternative and improved means of support for flashlights having no holder. It is a further object of this invention provide an improved means of controlling a flashlight when using another article or device, such as a firearm.

SUMMARY OF THE INVENTION

According to the invention there is provided a flashlight holder comprising a collar, a spacer arm and a gripping arm. The collar is operative to slidably attach to a flashlight housing proximate a flashlight head. The spacer arm is dimensioned to fit between a thumb and an index finger and is coupled to the collar so as to extend outwardly therefrom. The gripping arm is dimensioned to rest snugly in the palm of a hand and is coupled to the spacer arm at a junction remote from the collar and forms an oblique angle with the spacer arm. In this embodiment, the spacer arm has a length sufficient to permit a user to hold the gripping arm in the palm of the user's hand with the spacer arm between the user's thumb and index finger while the collar is attached to the flashlight housing proximate the flashlight head so as to permit the user to control the flashlight.

The spacer arm may have a substantially flat-faced body so as to fit snugly between the thumb and index finger. The spacer arm can include a finger notch.

The collar may include an elongated base from which the spacer arm extends such that the spacer arm is coupled to a distal end of the base and the base is dimensioned so that the user's hand fits snugly against the base when the gripping arm is held in the palm of the hand. The elongated base, spacer arm and gripping arm can be coupled to form a U-like handle which fits between the thumb and index finger.

The collar may include a threaded aperture operative to receive a set screw so as to firmly engage the collar to the flashlight housing. The collar may be tubular and include a friction enhancing surface on an interior surface thereof. The collar may have a split tubular shape. The collar may also have a cutout dimensioned to fit around a manual on/off switch so as to lock the collar to the flashlight housing without interfering with the on/off switch.

In one embodiment, the flashlight holder comprises a collar and a band-like body which forms a handle. The band-like body is coupled to the collar and dimensioned to encircle the back of a user's hand and at least a portion of the user's palm. The band-like body includes an inner sidewall dimensioned to fit snugly against a back of the user's hand so as to permit a user to hold the band-like body while the collar is attached to the flashlight housing. In this embodiment, the collar extends from an outer surface of the band-like body so as to be positioned proximately above the back of the user's hand when the band-like body is held by the user. The band-like body may include two distal curved ends dimensioned to rest snugly in the palm of the user's hand such that the band-like body has an flattened C-like cross-section. This embodiment may also include means for pivotally coupling the collar to the band-like body so as to permit the band-like body to be pivoted relative to the collar.

In another embodiment of the invention, the flashlight holder comprises a collar coupled to a band-like body, wherein the band-like body is coupled to the collar and dimensioned to permit a number of fingers to snugly fit therethrough so as to permit a user to hold the band-like body. The collar is operative to attach to the flashlight housing and extends from the band-like body such that while the collar is attached to the flashlight housing and the band-like body is held by a user, the flashlight is positionable on the back-side of the user's hand. The band-like body serves as a handle which is to be held by one or more fingers and may be oriented at an oblique angle to the collar. The band-like body may form a ring operative to be held by a single finger. Alternatively, the band-like body may be dimensioned so as to be held by two or more fingers.

In yet another embodiment of the invention there is provided a flashlight holder comprising a collar and a trigger guard engaging mechanism. The collar is operative to slidably attach to a flashlight housing. The trigger guard engaging mechanism is operative to removably attach to a trigger guard of a firearm. In this variation, the collar extends from the trigger guard engaging mechanism such that when the trigger guard engaging mechanism is attached to the trigger guard, the collar is oriented so as to substantially align a flashlight mounted to the collar in a firing direction of the firearm. The trigger guard engaging mechanism can include a substantially U-shaped body sized to fit around the trigger guard. Furthermore, the substantially U-shaped body may have a central axis which is substantially perpendicular to a central axis of the collar.

In another embodiment of the invention, the flashlight holder comprises a collar attached to a U-shaped body, wherein the U-shaped body is operative to removably attach and conform to the shape of the forestock or barrel of the firearm. The collar attaches to the flashlight housing and extends from the U-shaped body such that with the collar so attached and the U-shaped body attached to the forestock or barrel of the firearm, the flashlight is positioned directly beneath the U-shaped body and oriented in a firing direction of the firearm. The U-shaped body may include one or more threaded apertures operative to receive a set screw so as to firmly engage the U-shaped body to the forestock of the firearm. The U-shaped body may include a friction enhancing surface on an interior surface thereof. The U-shaped body may also be rounded at the top to conform to the shape of a rounded forestock or barrel of a firearm.

In another aspect of the invention, the embodiment described above may include a collar which is coupled to the U-shaped body in a lateral position instead of the underside of the U-shaped body, and is oriented in the firing direction of the firearm.

In another aspect of the invention, the collar may be coupled to one side of the U-shaped body in an anterior position instead of to the underside of the U-shaped body, and be oriented so that its axis is in the firing direction of the firearm.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

Figure 1:
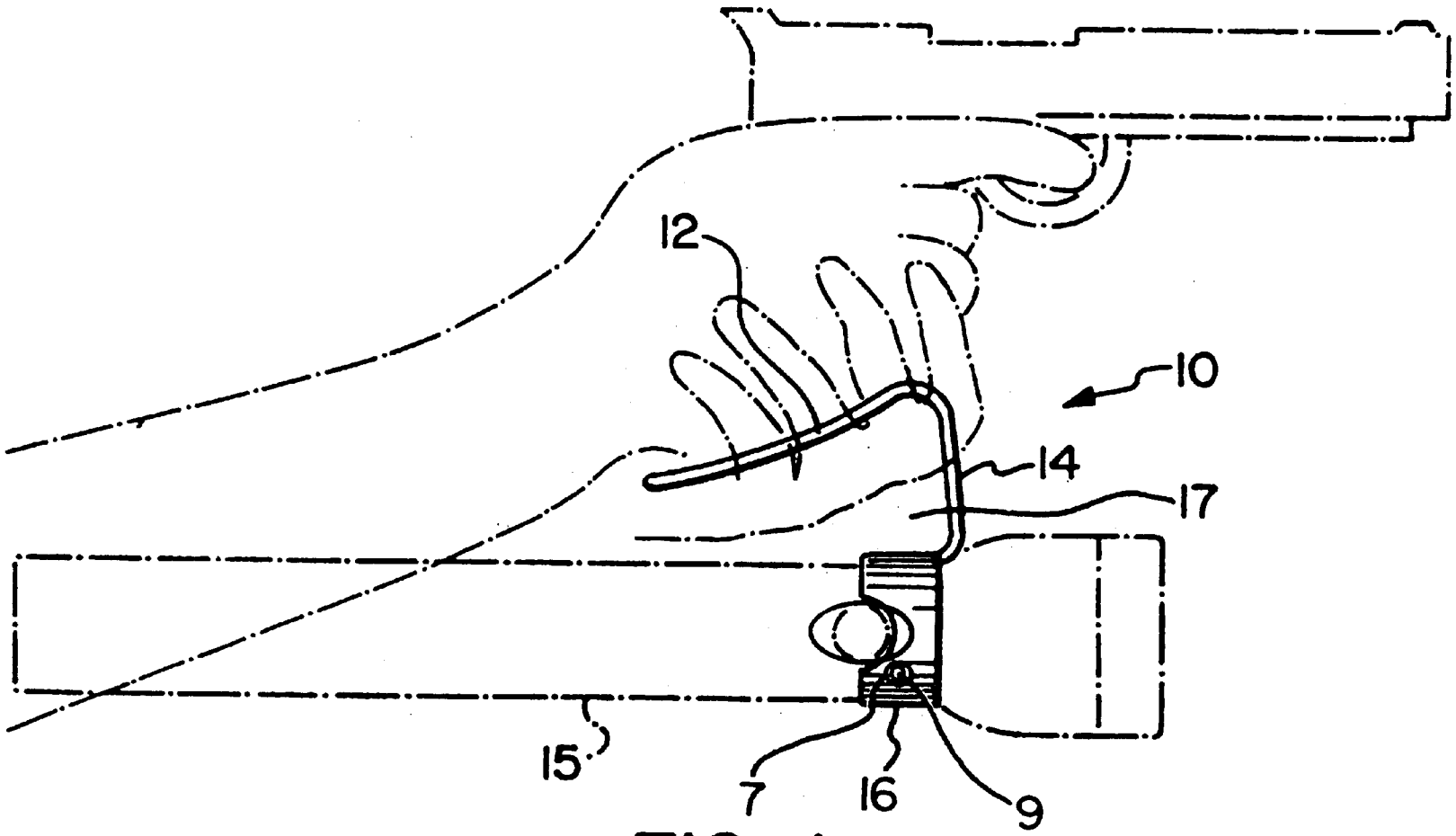
FIG. 1 is a side view of a flashlight holder attached to a flashlight and carried in one hand simultaneously while the other hand is holding a gun.

It will be appreciated that for simplicity and clarity of illustration, elements illustrated in the accompanying drawings have not necessarily been drawn to scale. For example, the dimensions of some of the elements are exaggerated relative to other elements for clarity. Furthermore, where considered appropriate, reference numerals have been repeated among the drawings to indicate corresponding or analogous elements.

DETAILED DESCRIPTION WITH REFERENCE TO THE DRAWINGS

Referring to FIG. 1, there is illustrated flashlight holder 10 from applicant's co-owned U.S. patent application Ser. No. 08/713,217, now issued as U.S. Pat. No. 5,743,623, the whole of which is incorporated hereto. Flashlight holder 10 comprises cantilevered arm 12, spacer 14 and tubular collar 16. Spacer 14 extends outwardly from collar 16 and is dimensioned so that when collar 16 is attached to the housing of a flashlight 15 a passageway 17 is formed between the flashlight 15 and arm 12. Holder 10 is attachable to flashlight 15 by spreading apart collar 16 and sliding collar 16 into place along the housing of flashlight 15. Once collar 16 is located substantially close to the head of flashlight 15, the arms of collar 16 are released allowing collar 16 to clamp or frictionally attach to flashlight 15. Collar 16 may include threaded aperture 7 with set screw 9 inserted therethrough. Collar 16 may be further firmly engaged to the housing of flashlight 15 by tightening set screw 9 into threaded aperture 7 so that the set screw firmly abuts the flashlight housing. An interior sidewall of collar 16 may also include grooved serrations or frictionally adhesive material so as to improve the frictional engagement of collar 16 to a flashlight housing.

Figure 2:
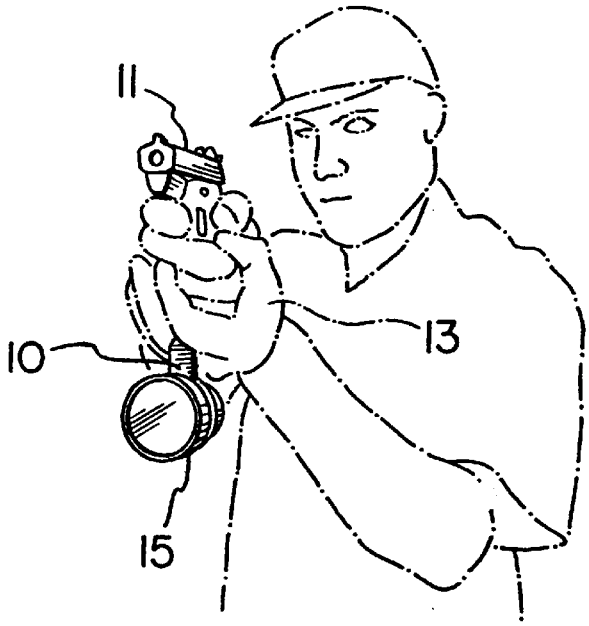
FIG. 2 is a perspective view of a user holding the flashlight holder from FIG. 1 so as to control a flashlight and a firearm.

As shown in FIG. 2, flashlight holder 10 enables the user to hold a flashlight 15 with a hand 13 while permitting the user to freely use hand 13 for other purposes, such as retaining a firearm 11.

Figure 3:
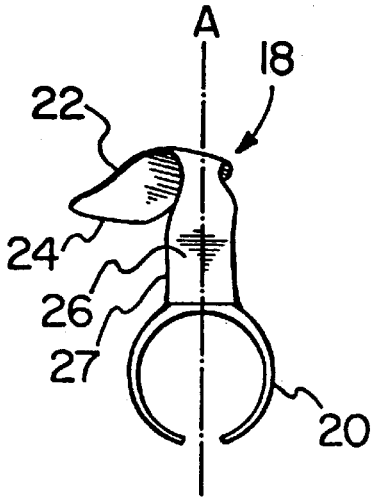
FIG. 3 is a front view of an embodiment of a flashlight holder in accordance with the present invention.
Figure 4:
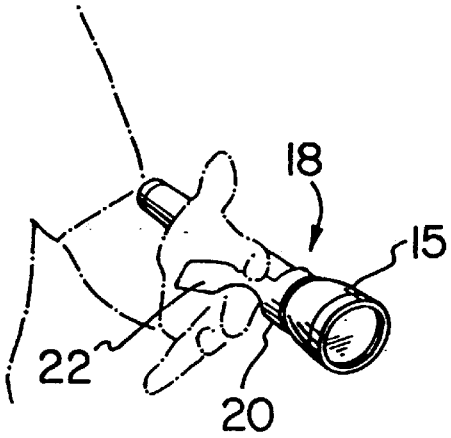
FIG. 4 is a perspective view of the flashlight holder in FIG. 3 as held by a user.
Figure 5:
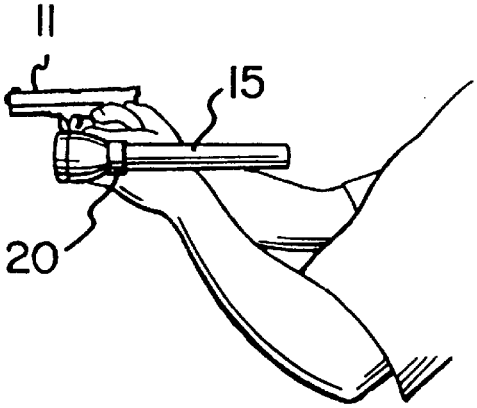
FIG. 5 is a side view of the flashlight holder in FIG. 3 as held by a user.

Referring to FIG. 3, there is shown a modified flashlight holder 18 as presented in co-owned U.S. patent application Ser. No. 09/014/037 filed Jan. 27, 1998, now issued as U.S. Pat. No. 5,848,834, the whole of which is incorporated hereto. Flashlight holder 18 includes collar 20 coupled to cantilevered arm 22 having distal end 24. Collar 20 is dimensioned so as to firmly attach to the housing of a flashlight. For illustration purposes, collar 20 may have an annular or penannular cross-section. Cantilever arm 22 is arranged to extend from spacer 26 at an oblique angle such that distal end 24 is more to one side 27 of spacer 26. In this way, cantilevered arm 22 can extend away from axis A of spacer 26. Advantageously, when arm 22 is oriented to extend to one side 27 of spacer 26 at an oblique angle, flashlight holder 18 may be more readily used to hold a flashlight 15 alongside a user's arm, as illustrated in FIG. 4 and 5. Flashlight holder 18 thus allows a user to hold flashlight 15 alongside firearm 11 such that the flashlight can be directed in an alternative way substantially towards the line of fire of firearm 11. In FIGS. 4 and 5, flashlight holder 18 is shown coupled to a larger flash light, such as a Mag-Lite™, however, it will be appreciated that invention is contemplated for use with other types of flashlights, both large and small.

Figure 6:
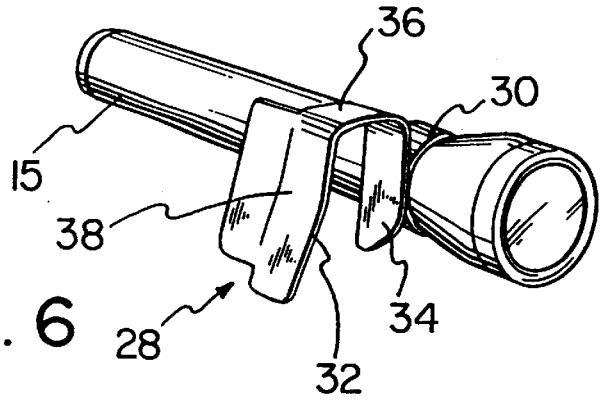
FIG. 6 is a perspective view of another embodiment of a flashlight holder coupled to a flashlight in accordance with the present invention.
Figure 7:
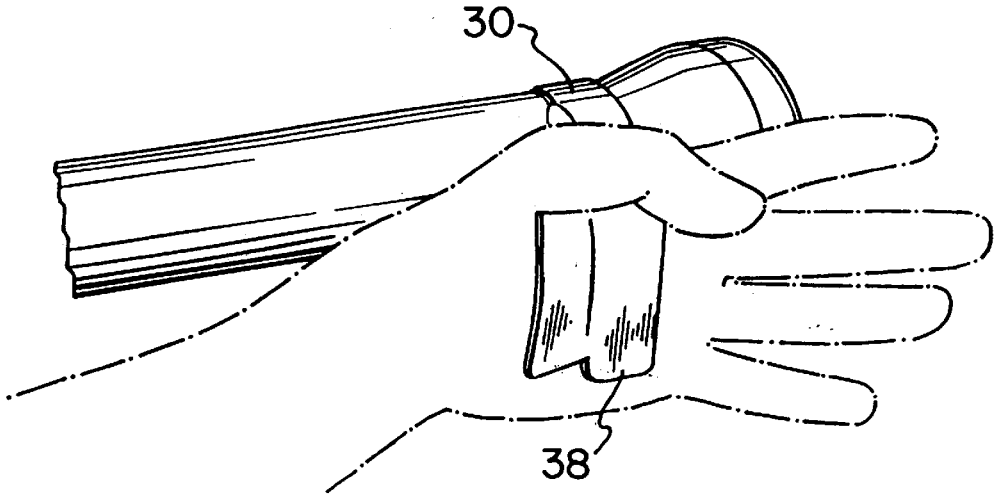
FIG. 7 is a perspective view of the flashlight holder in FIG. 6 as held by a user.
Figure 8:
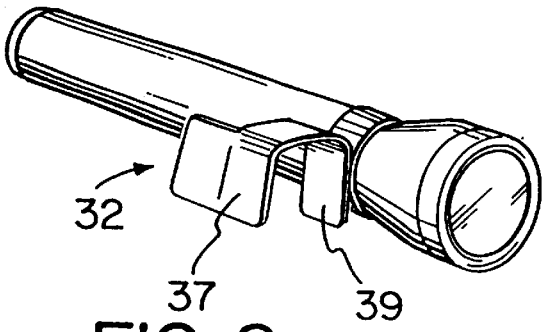
FIG. 8 is a perspective view of an embodiment of a flashlight holder in accordance with the present invention.
Figure 9:
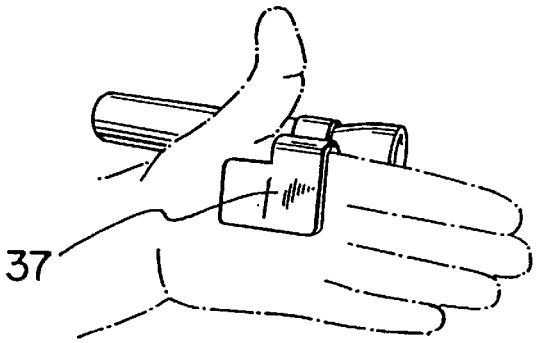
FIG. 9 is a side view of the flashlight holder in FIG. 8 as held by a user.

Referring to FIG. 6, another embodiment is shown wherein flashlight holder 28 comprises collar 30 coupled to handle 32. Collar 30 is operative to clamp to the housing of flashlight 15 and is shown coupled to handle 32 at base 34. Handle 32 includes spacer 36 and gripping arm 38. Spacer 36 extends outwardly from collar 30 proximate an end of base 34 and is dimensioned to permit a hand to snugly rest between gripping arm 38 and base 34. Spacer 36 is further dimensioned to fit between the thumb and index finger, as can be seen in FIG. 7. Gripping arm 38 is dimensioned to rest comfortably in the palm of a hand. In the embodiment shown in FIG. 7, base 34, spacer 36 and gripping arm 38 are arranged so that handle 32 has a U-like cross section. Preferably, holder 28 enables a user to position a flashlight on the back-side of the user's hand so that, for instance, the user may use the same hand to grip a portion of a firearm held in the other hand. For smaller flashlights, handle 32 may have a gripping arm 37 which is dimensioned to extend only partially across the palm of a hand fitted between gripping arm 37 and base 39, as depicted in FIGS. 8 and 9. Such an embodiment offers the user a more compact model.

Figure 10:
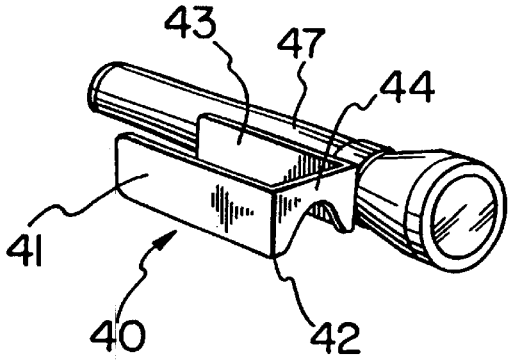
FIG. 10 is a perspective view of another embodiment of a flashlight holder coupled to a flashlight in accordance with the present invention.
Figure 11:
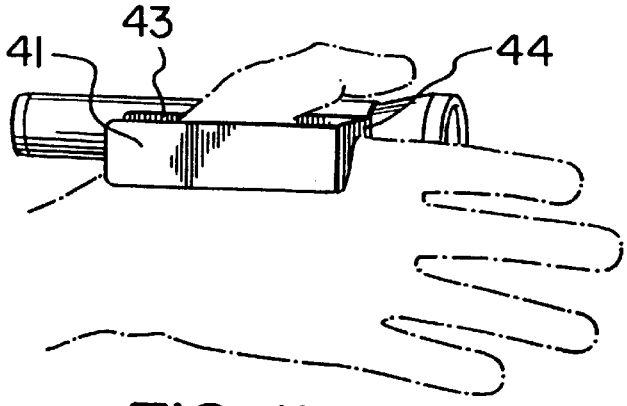
FIG. 11 is a side view of the flashlight holder in FIG. 10 as employed by a user.

Referring to FIG. 10, flashlight holder 40 includes handle 42 having two substantially parallel sidewalls 41 and 43 separated from one another by spacer 44 which is dimensioned to fit snugly between a user's thumb and the user's index finger. Preferably, sidewalls 41 and 42 are aligned with spacer 44 such that handle 42 has a U-like cross section so as to permit handle 42 to be readily held by a user's thumb without slipping out of position on the hand, as illustrated in FIG. 11.

Figure 12:
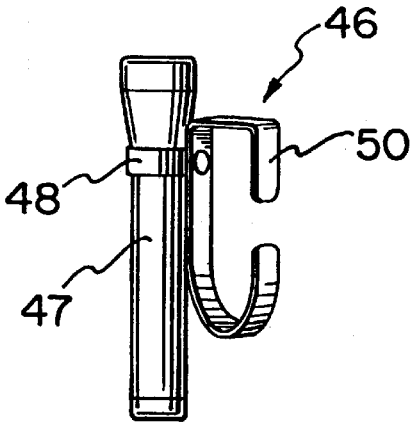
FIG. 12 is a perspective view of another embodiment of a flashlight holder coupled to a flashlight in accordance with the present invention.
Figure 13:
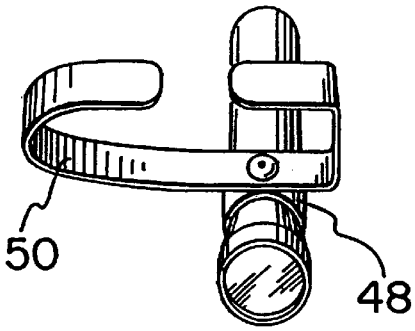
FIG. 13 is a side view of the flashlight holder in FIG. 12 as employed by a user.
Figure 14:
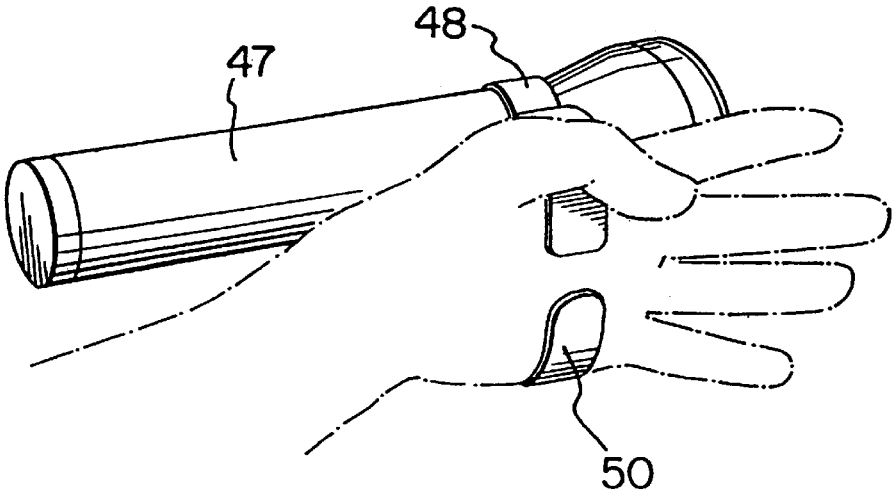
FIG. 14 is a perspective view of the flashlight holder in FIG. 12.

Referring to FIG. 12, flashlight holder 46 includes collar 48 coupled to handle 50 having a band-like shape so as to encircle or partially encircle a portion of a user's hand. Handle 50 advantageously enables the user to control a flashlight with holder 46 while freeing up the user's fingers for other uses, as shown in FIG. 14. As can be seen from the combination of FIGS. 12 and 13, handle 50 may also be pivotally mounted to collar 48 so as to provide improved flexibility and compactness for the user.

Figure 15:
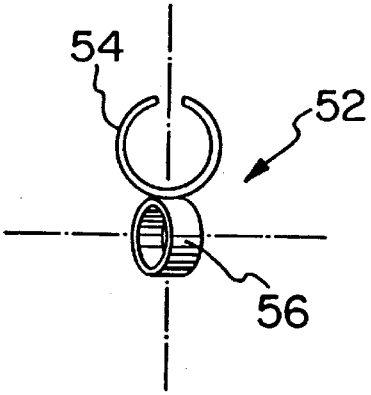
FIG. 15 is a perspective view of another embodiment of a flashlight holder in accordance with the present invention.
Figure 16:
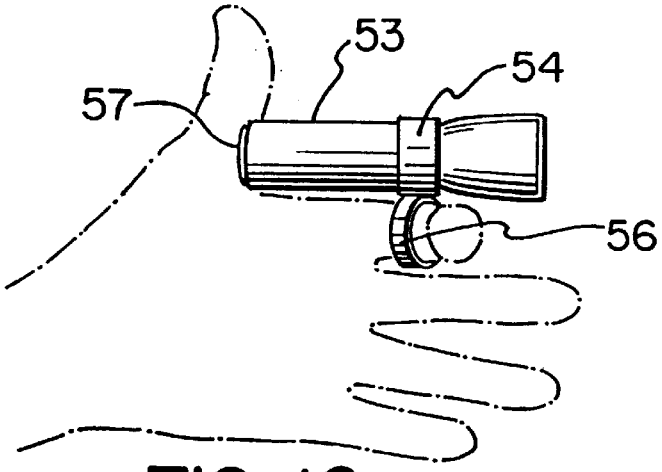
FIG. 16 is a perspective view of the flashlight holder from FIG. 15, coupled to a flashlight and employed by a user, in accordance with the present invention.
Figure 17:
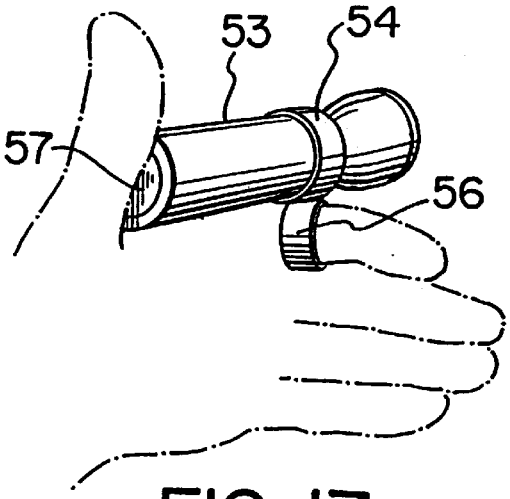
FIG. 17 is another perspective view of FIG. 16.

Referring to FIG. 15, another variant of flashlight holder 52 comprises collar 54 coupled to handle 56 which is shaped in a ring-like manner so as to permit the passage of a user's finger therethrough. Collar 54 may have an annular or penannular cross-section, as may handle 56. Advantageously, collar 54 and handle 56 may be oriented with each other such that a notional plane perpendicular with the axis of revolution C of collar 54 intersects at an oblique angle another notional plane perpendicular with the axis of revolution D of handle 56. As illustrated in FIGS. 16 and 17, orientation of handle 56 with respect to collar 54 such that their respective cross-sections intersect at an oblique angle permits a user to more readily control the direction of a flashlight when flashlight holder 52 is attached thereto. It will be appreciated that although collar 54 and handle 56 are shown such that their cross-sections are substantially in alignment along axis B, a number of different orientations are possible which are also contemplated within the scope of the invention.

Figure 18:
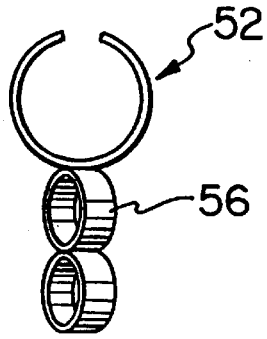
FIG. 18 is a perspective view of another embodiment of a flashlight holder in accordance with the present invention.

Flashlight holder 52 is particularly useful for smaller flashlights, such as the Sure Fire™ 6P which may be obtained from Laser Products of Fountain Valley, Calif. A growing number of such flashlights include a quick control, rear-mounted on/off switch 57 which, when depressed, turns the flashlight on, and otherwise turns the flashlight off. Such a mechanism has been found to be particularly useful and desirable in such areas as law enforcement, where officers often are in need of the ability to quickly turn on and off a flashlight. As with other conventional flashlights, however, there is a continuing need for a device which enables a user to control a flashlight with one hand, while being able to use the same hand to readily control other articles or devices, such as firearms. In the variant illustrated in FIG. 15, it has been discovered that using flashlight holder 52 in combination with a small flashlight 53, a user may readily hold and control the small flashlight using only two fingers of a hand, thereby permitting the user to make use of the same hand for other activities such as concurrently holding a firearm, a truncheon, a police badge or a hand-held radio. As shown in FIG. 18, handle 56 may include a plurality of ring-like bodies, so that a user may control holder 52 with additional fingers.

Figure 19:
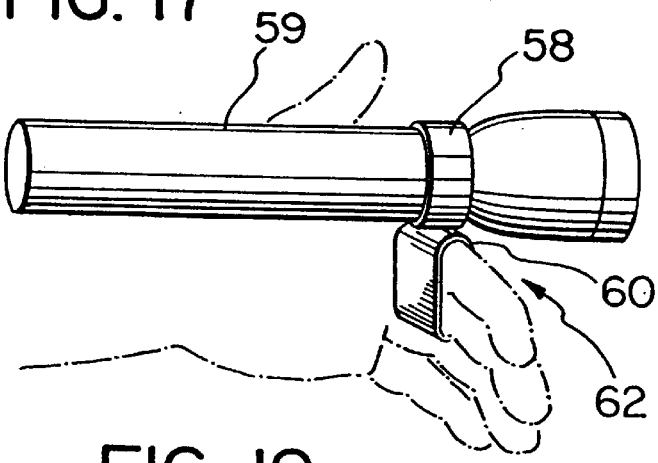
FIG. 19 is a perspective view of another embodiment of a flashlight holder, coupled to a flashlight and employed by a user, in accordance with the present invention.

A larger variant of flashlight holder 52 is illustrated in FIG. 19, wherein handle 60 has a band-like shape and is dimensioned to snugly retain two or more fingers for greater control. In the embodiment shown, handle 60 is aligned with collar 58 at an oblique angle so as to permit the user to use the thumb to readily control an on/off switch on a flashlight coupled to the flashlight holder.

Figure 20:
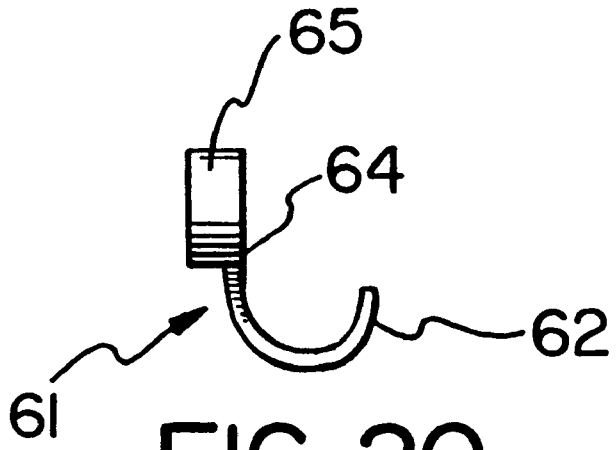
FIG. 20 is a side view of another embodiment in accordance with the invention.
Figure 21:
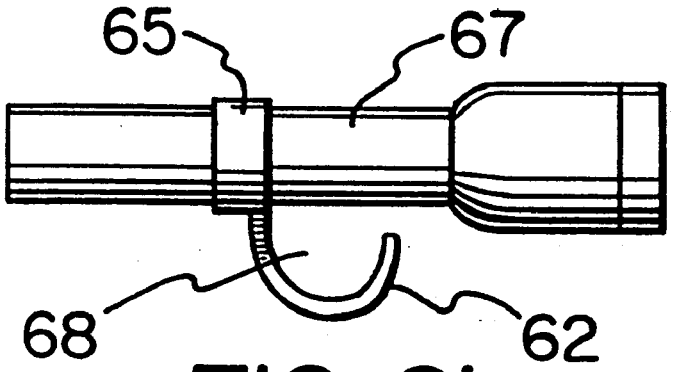
FIG. 21 is a side view of the embodiment in FIG. 20 attached to a flashlight.

Referring to FIG. 20, there is shown another variant of the invention having a ¾ ring 62 which extends to one side 64 of collar 65. As depicted in FIG. 21, when collar 65 is attached to a flashlight housing, a distal end 66 of ¾ ring 62 extends towards and substantially parallel with the flashlight housing 67 so as to form, in combination with the flashlight housing 67, a substantially complete aperture 68 dimensioned to comfortably fit a user's finger. Such an embodiment is preferred when attaching flashlight holder 61 to elongated tubular flashlights having end cap on/off switches so as to provide improved stability for the user controlling such flashlights with holder 61.

Figure 22:
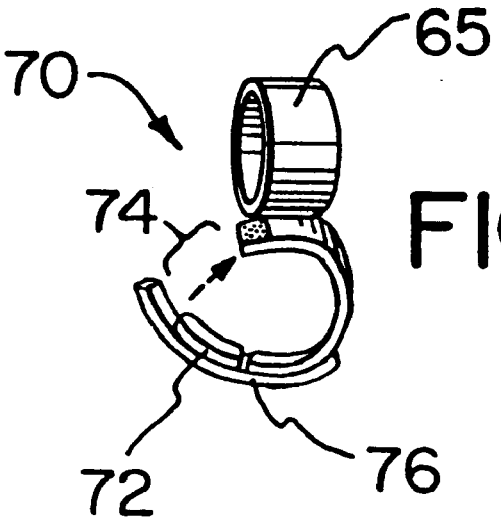
FIG. 22 is a perspective view of another embodiment in accordance with the invention.

Referring to FIG. 22, in another variant of the flashlight holder contemplated herein, handle 70 contains a detachable sidewall section 72. In this variant, sidewall section 72 is large enough such that, when detached from handle 70, a passageway 74 is formed sufficient to permit a user's finger engaging the ring handle 70 to pass therethrough. Detachable sidewall section 72 may be attached to handle 70 with conventional means such as velcro 76 or a hinge. Section 72 offers the user the additional ability to quickly disengage one or more fingers engaging the handle 70.

Figure 23:
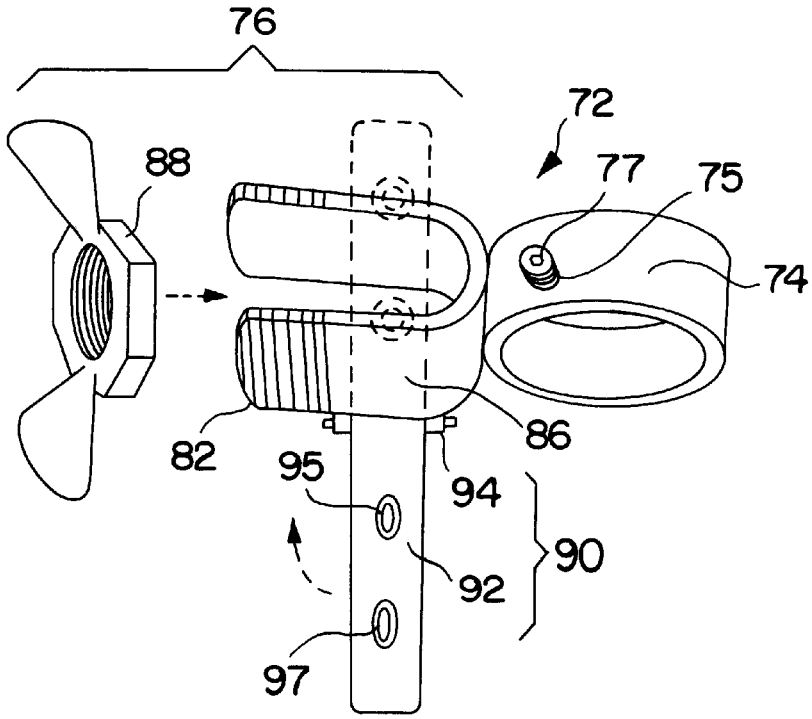
FIG. 23 to illustrate additional embodiments of flashlight holders capable of being removably attached to a trigger guard of a firearm.
Figure 24:
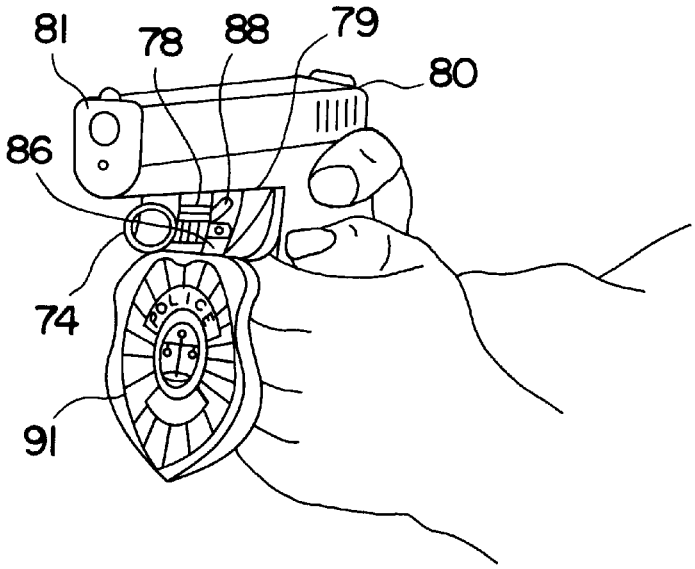

Referring to FIGS. 23 and 24, there is shown in another variant of the invention wherein flashlight holder 72 comprises collar 74 coupled to a trigger guard engaging mechanism 76. In this embodiment, engaging mechanism 76 removably attaches to the trigger guard 78 of a firearm 80, thereby enabling a flashlight to become an integral component of the firearm. This variation allows the user to operate the firearm and a flashlight coupled to the flashlight holder 72 as a single unit.

In the illustrative embodiment shown in FIGS. 23 and 24, trigger guard engaging mechanism 76 includes threads 82 at distal end 84 of U-shaped body 86. Threads 82 are sized to receive a locking mechanism such as wing nut 88 which can be screwed onto threads 82 once U-shaped body 86 is mounted around trigger guard 78. U-shaped body 86 is sized to fit snugly around trigger guard 78. Preferably, U-shaped body 86 has a central axis which is substantially perpendicular to the central axis of collar 74. Collar 74 can include a set screw 77 and set screw aperture 75 as previously discussed to secure a flashlight housing to collar 74. It is important to note that the trigger guard engaging mechanism 76 should be dimensioned such that when it is mounted to trigger guard 78, the space between trigger guard 78 and trigger 79 is not reduced substantially, so as to ensure that a user's ability to comfortably operate the trigger 79 is not hampered. When mounted flashlight holder 72 is attached to firearm 80, collar 74 can retain a flashlight housing mounted therein such that the flashlight head is substantially aligned in the direction of muzzle end 81 so that a beam of light may be projected towards a direction targeted by the firearm.

As also illustrated in FIGS. 23 and 24, flashlight holder 72 may include badge holder 90 which may be removably mounted to trigger guard engaging mechanism 76. Badge holder 90 provides further functionality to flashlight holder 72, enabling a using to mounted an identification badge 91 to the badge holder 90 as shown in FIG. 24. In the embodiment shown, badge holder 90 comprises mounting strip 92 coupled to engaging mechanism 76 with mounting pin and frame 94. Mounting strip 92 may include apertures 95 and 97 sized to receive a badge pin for ease of mounting a badge to the strip. Mounting strip 92 may also be rotatable about pin and frame 94 such as to a position shown in the dotted outline to provide added flexibility in use and storage. The addition of badge holder 90 enables a user to mount both a flashlight and an identification badge to firearm 80 such that both the flashlight and the badge can be directed towards the front, or muzzle end, of the firearm. This enables a user to quickly illuminate the target surroundings and provide immediate identification with the I.D. badge, while simultaneously operating firearm 80. The additional functionality provided in combining flashlight holder 72 and badge holder 90 can be particularly important for law enforcement officers, security officers and military personnel involved in life-threatening operations wherein lighting and proper identification are important both for their own safety and for the safety of others.

Figure 25:
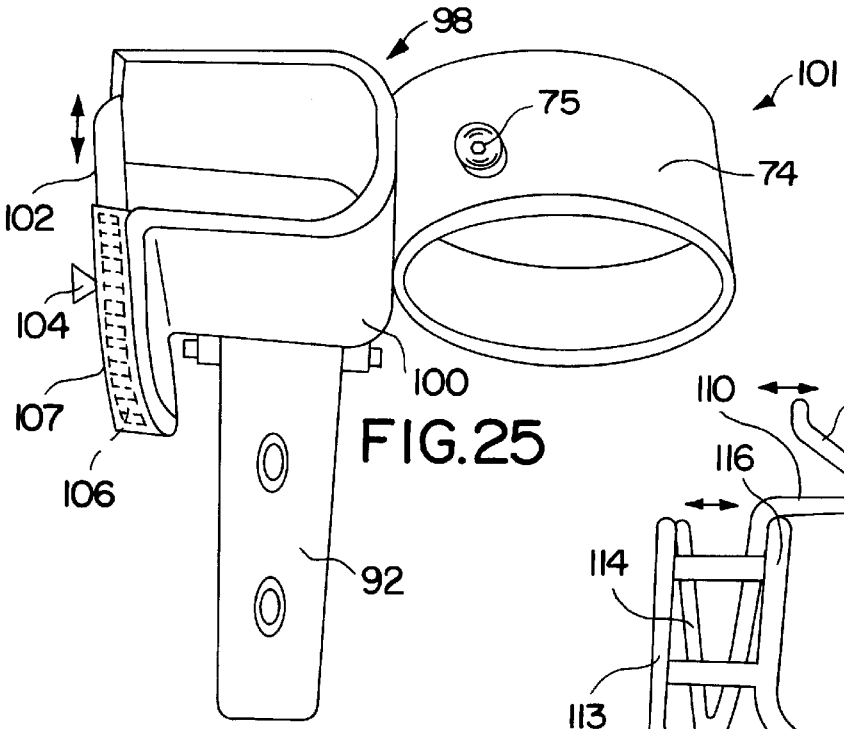

FIGS. 25 to 31 illustrate variations of the flashlight holder 72 shown in FIG. 23. In FIG. 25, trigger guard engaging mechanism 98 comprises a U-shaped frame 100 coupled to spring activated latch 102 which is resiliently positioned to cover the open end 103 of U-shaped frame 100 so as to removably lock the flashlight holder 101 to a trigger guard. Trigger guard engaging mechanism 98 can be attached and detached from a trigger guard by sliding spring activated latch 102 with guide arm 104 into an open position wherein U-shaped frame 100 is uncovered, and releasing guide arm 104 once the U-shape frame 100 is in position around the trigger guard at which point latch 102 is resiliently returned to its covered position by spring 106 located in mounting compartment 107.

Figure 26:
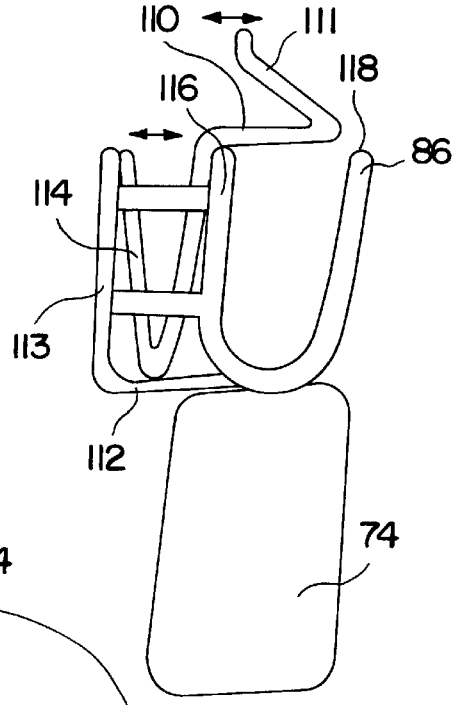
Figure 27:
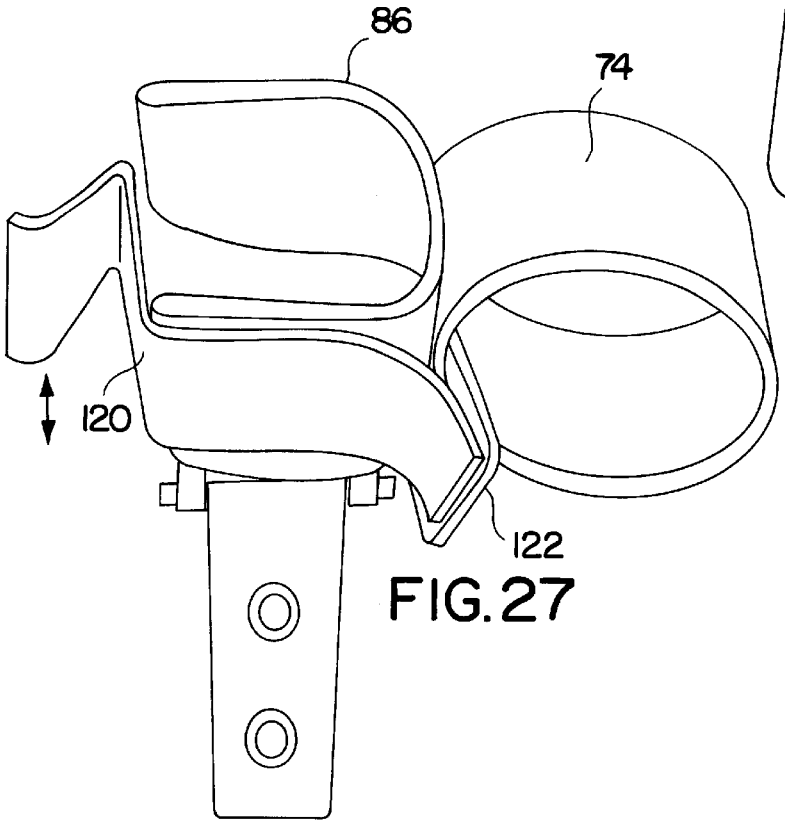
Figure 28:
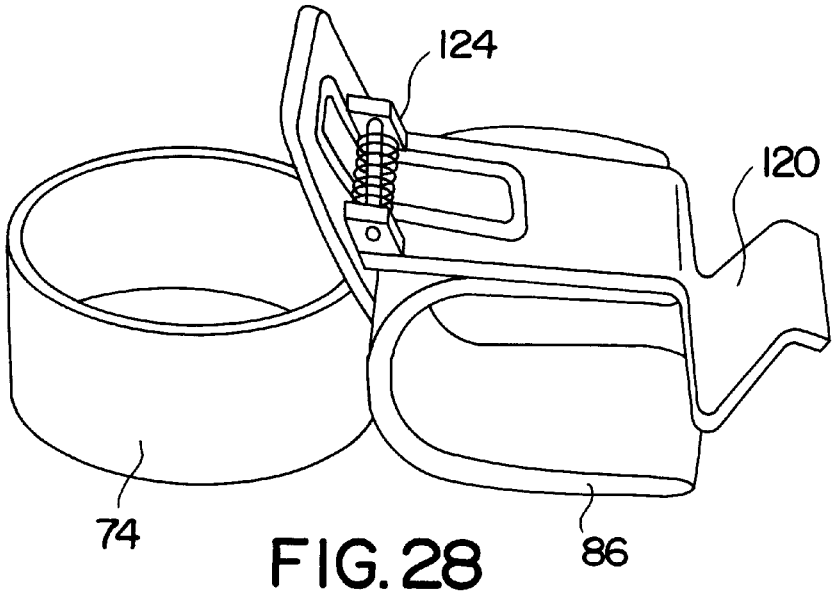

Referring to FIG. 26, another embodiment of flashlight holder 72 includes a latch 110 made of spring metal or plastic, mounted in a spring loading compartment 112 and having a resilient end 114 pressed between an outer end 113 of compartment 112 and one side 114 of U-shaped body 86 such that latch 110 rests in a closed position covering the open end 118 of U-shaped body 86. Latch arm 111 extends from latch 110 to enable a user to readily press latch 110 open so that the U-shaped body 86 can be mounted to a trigger guard. Once mounted, the latch arm 111 is released and latch 110 resiliently returns to its closed position over the U-shaped body, thereby locking the flashlight holder to the firearm. In a variation of the embodiment in FIG. 26, FIG. 27 shows a latch 120 made of spring metal or plastic wherein latch 120 is mounted to a mounting flange or lip 122 as opposed to a spring loading compartment. Alternatively, latch 120 may be coupled to a double torsion spring mechanism 124 which spring loads latch 120, as illustrated in FIG. 28

Figure 29:
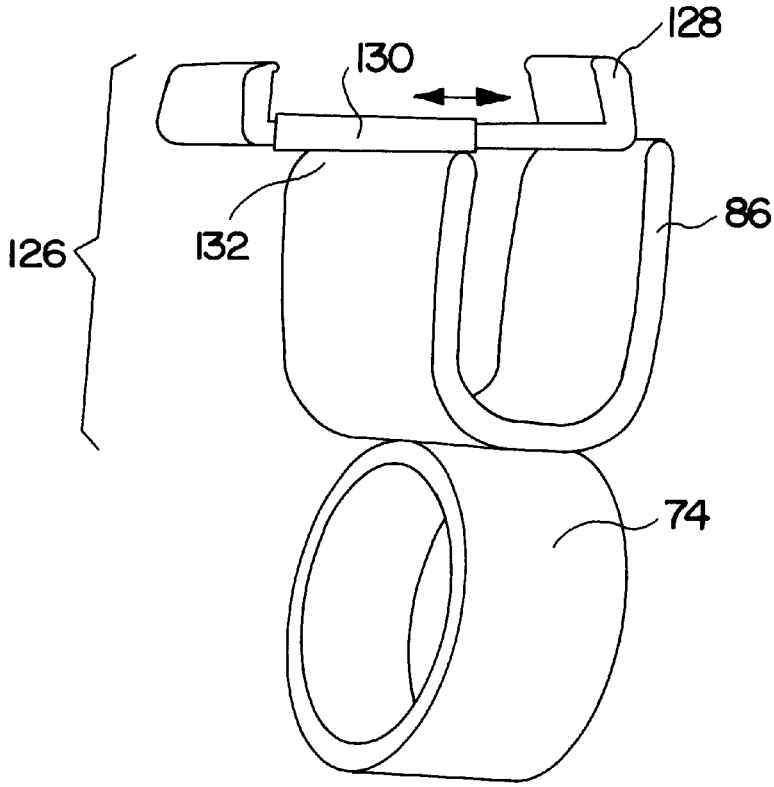

FIG. 29 shows another embodiment of the flashlight holder in FIG. 23, wherein trigger guard engaging mechanism 126 comprises a U-shaped body 86 and a slidable latch 128 mounted snugly to a guide channel 130. As illustrated, guide channel 130 is coupled to a distal end 132 of U-shaped body 86 and aligned so as to guide slidable latch 128 towards a closed position covering U-shaped body 86. In this embodiment, slidable latch 128 can be snugly guided into the closed position to lock the U-shaped body 86 to a trigger guard, and may also be snugly guided into an open position to enable the release of the U-shaped body 86 from the trigger guard.

Figure 30:
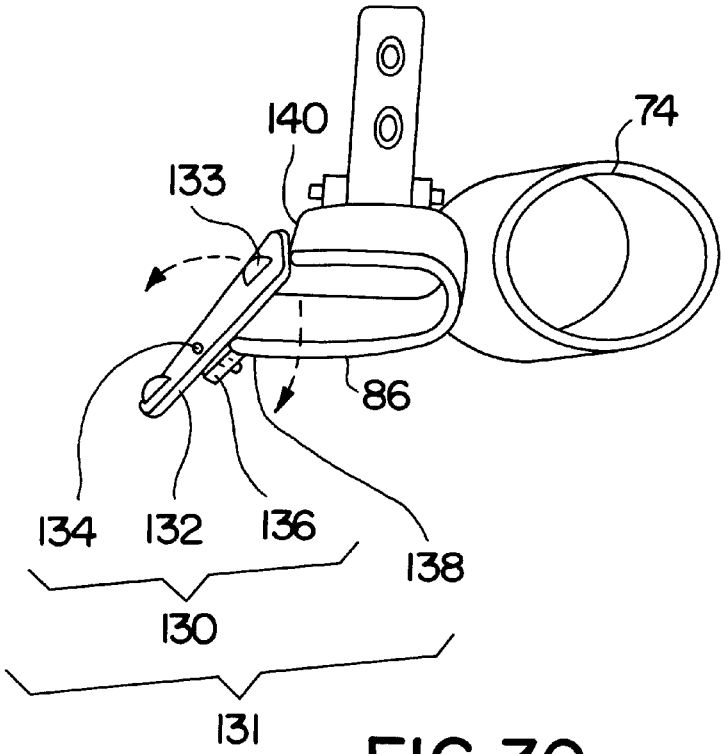

Yet another variant of the flashlight holder in FIG. 23 is illustrated in FIG. 30. In this latter embodiment, U-shaped body 86 has mounted at its open end 140 a rotatable latch 130 comprising a latch member 132 coupled to a rotating pin 134 and support base 136. As illustrated in FIG. 30, support base 136 is mounted to a distal end 138 of U-shaped body 86 and is arranged so as to align latch member 132 with open end 140 of U-shaped body 86. Latch member 132 snugly rotates into a locked and unlocked position thereby enabling a user to snugly and removably mount trigger guard engaging mechanism 131 to a trigger guard. Latch member 132 may include guide tabs 133 at opposing ends of member 132 to easily guide and rotate latch member 132.

Figure 31:
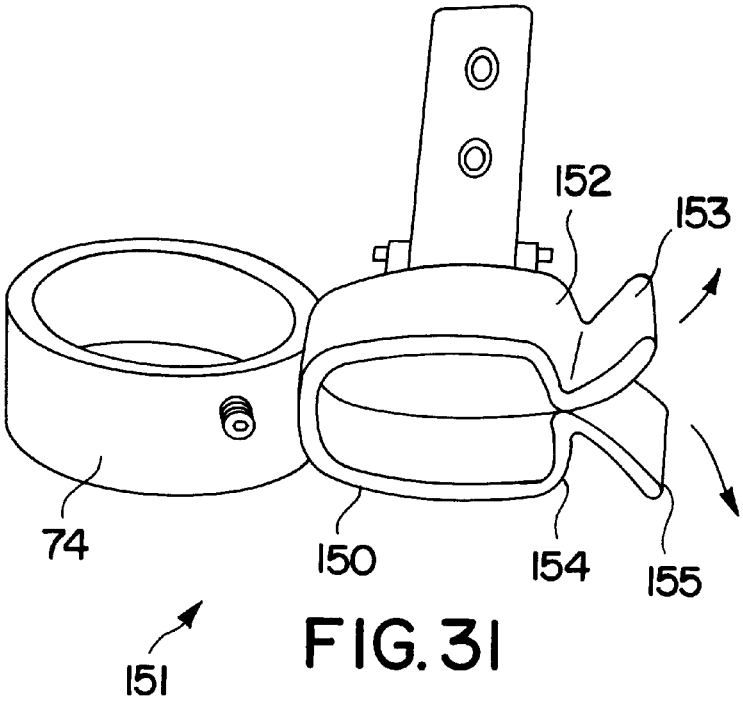

Referring to FIG. 31, in yet another embodiment of the flashlight holder in FIG. 23, the U-shaped body 150 itself may be spring loaded such that each end 152 and 154 bends inwardly towards the other. Ends 152 and 154 must have sufficient resilience to enable a user to open ends 152 and 154 apart enough to mount and unmount U-shaped body 150 onto and from a trigger guard such that when the ends 152 and 154 are released around a trigger guard, flashlight holder 151 is mounted securely to the firearm. Latch handles 153 and 155 assist in opening and closing ends 152 and 154.

The flashlight holders illustrated herein may be readily made of known materials, such as metal or plastic.

While the present invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the spirit and scope of the invention.

What is claimed is:

1. A flashlight holder, comprising:

(a) a collar operative to slidably attach to a flashlight housing; and (b) a trigger guard engaging mechanism coupled to said collar and operative to removably attach to a trigger guard of a firearm; and wherein said trigger guard engaging mechanism contains no latch extending through or across an aperture defined by said trigger guard, and wherein said collar extends from said trigger guard engaging mechanism such that when said trigger guard engaging mechanism is attached to the trigger guard, said collar is oriented so as to substantially align a flashlight mounted to said collar in a firing direction of the firearm.

2. A flashlight holder according to claim 1, wherein said trigger guard engaging mechanism comprises a substantially U-shaped body sized to fit around the trigger guard.

3. A flashlight holder according to claim 2, wherein said substantially U-shaped body has a central axis which is substantially perpendicular to a central axis of said collar.

* * * * *